United States Patent [19]

Karlowicz

[11] 4,125,182

[45] Nov. 14, 1978

[54] PUNCH PRESS CONTROLLER

[76] Inventor: Janusz R. Karlowicz, 2331 N. Kedzie Ave., Chicago, Ill. 60647

[21] Appl. No.: 840,564

[22] Filed: Oct. 11, 1977

[51] Int. Cl.[2] ..... B26D 5/00; H01H 29/26; H01H 35/10

[52] U.S. Cl. ..... 192/125 A; 83/61; 83/64; 83/66; 192/127; 200/80 R; 200/80 A

[58] Field of Search ..... 192/125 A, 127; 200/80 R, 80 A; 83/61, 64, 66, 67; 222/59

[56] References Cited

U.S. PATENT DOCUMENTS

| | | | |
|---|---|---|---|
| 846,832 | 3/1907 | Eden, Jr. | 83/361 |
| 1,137,908 | 5/1915 | Rumold | 200/80 A |
| 1,538,440 | 5/1925 | Littell et al. | 83/59 |
| 1,963,082 | 6/1934 | Fink et al. | 192/125 A |
| 2,241,556 | 5/1941 | MacMillin et al. | 192/130 |
| 2,674,334 | 4/1954 | Uberbacher | 200/80 R X |
| 2,758,172 | 8/1956 | Kromholz | 200/80 R |
| 2,900,909 | 8/1959 | Jordan | 102/70.2 |
| 3,095,097 | 6/1963 | Mellow | 200/80 R X |
| 3,393,589 | 7/1968 | Mills | 83/13 |
| 3,554,343 | 1/1971 | Calvert el al. | 192/127 |
| 3,953,691 | 4/1976 | Grosseau | 200/61.46 |

*Primary Examiner*—Allan D. Hermann
*Attorney, Agent, or Firm*—Steven Z. Szczepanski

[57] ABSTRACT

A controller for stopping a punch press when a stock material becomes jammed, includes: translating means for converting the motion of the stock material exiting from the punch press to rotational motion of rotating means which is operatively associated with said translating means, and a movable element, operatively associated with said rotating means. The rotational motion of rotating means produces centrifugal force which keeps the movable element in an operating position. As the stock material buckles or becomes jammed in the press, the motion of the exiting stock material ceases, causing a decrease in and/or subsequently elimination of the angular velocity of the rotating means and therefore a decrease in the magnitude of the centrifugal force. When the centrifugal force diminishes by a predetermined amount or is entirely eliminated, the movable element moves from the operating position to stopping position. As the movable element arrives in the stopping position, it actuates a switch which stops the operation of the punch press.

15 Claims, 7 Drawing Figures

FIG. 4
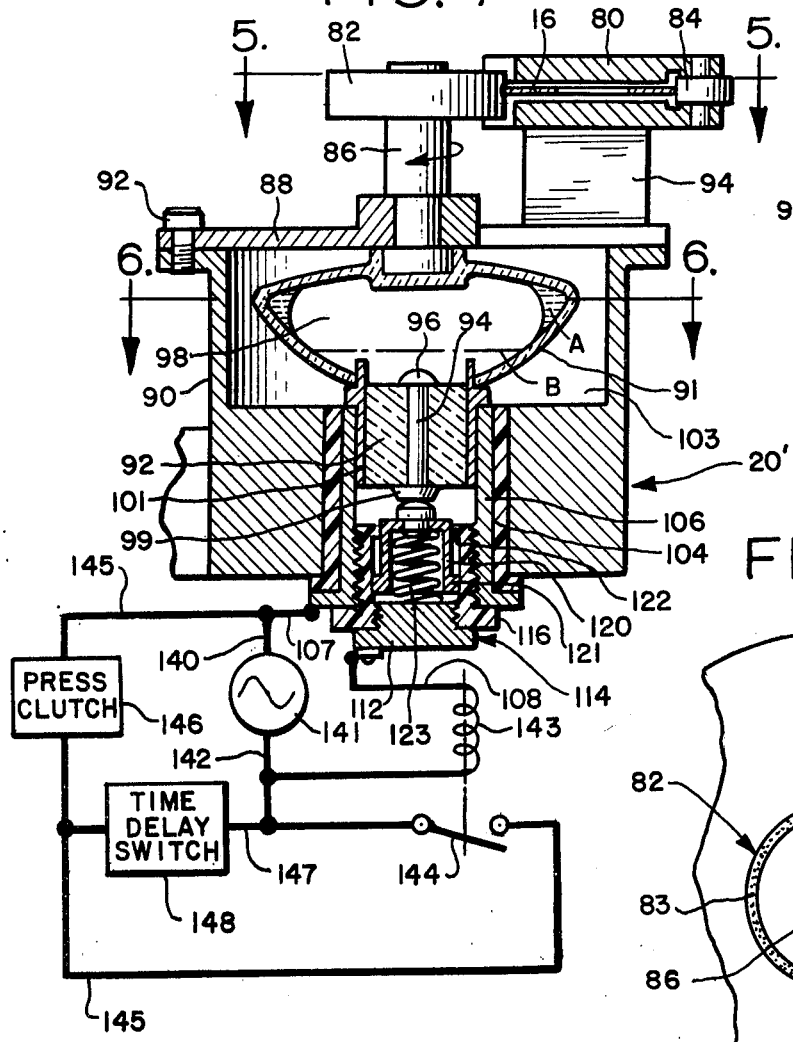
FIG. 6
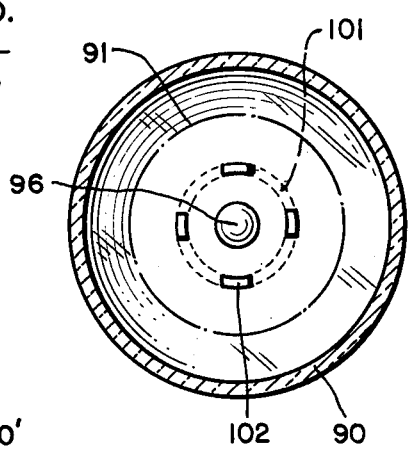
FIG. 5
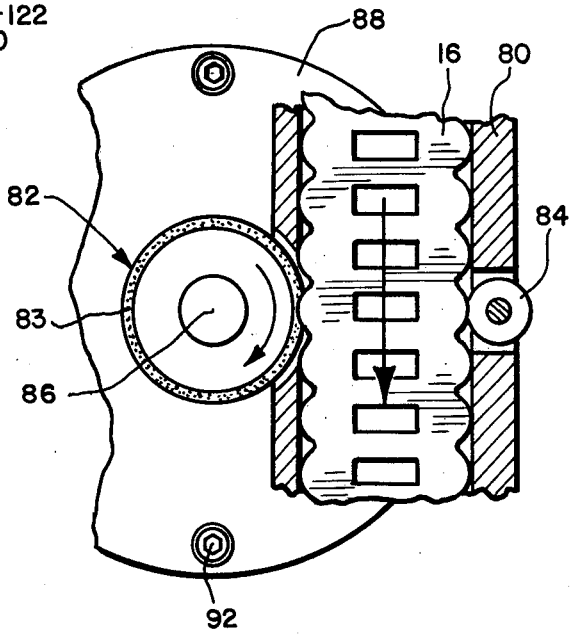
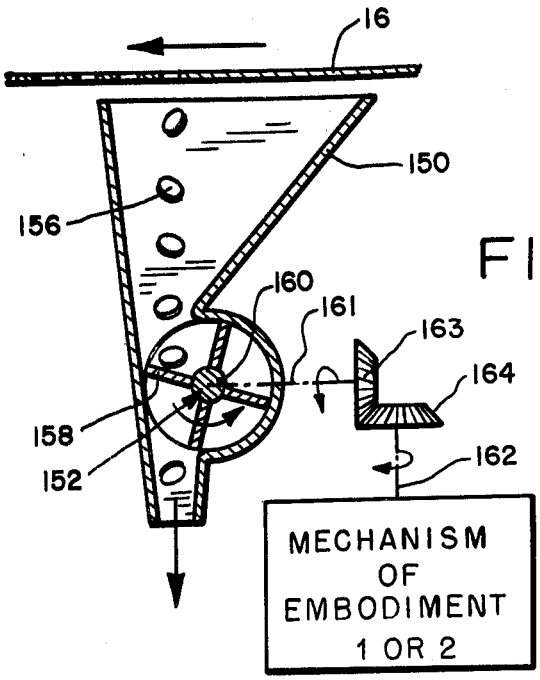
FIG. 7

PUNCH PRESS CONTROLLER

BACKGROUND OF THE INVENTION

This invention relates to mechanisms for controlling of punch presses. In particular, it relates to a control mechanism for automatically stopping a punch press when the stock material becomes jammed.

One of the commonly used methods of processing metals and other materials calls for passing a stock material (or a work piece), such as, a long strip or a tape, through a punch press. The tool of the punch press is designed to cut, punch, shape and perform other similar operations on the stock passed through the press. Occasional buckling or jamming of the tape, as it passes through the punch press, can seriously damage or even destroy the press and injure the operator unless the feed of the tape is stopped immediately. Photoelectric control systems have been used to detect stoppage of the tape as the result of jamming or buckling. Such systems are, however, extremely expensive.

The present invention provides a reliable, inexpensive controller for stopping a punch press when a stock material, such as, a tape passing therethrough becomes jammed.

Thus, one object of the present invention is to provide an improved controller for stopping a punch press in case of buckling or jamming of a work piece, such as, a tape.

Another object of the invention is to provide an improved punch press controller which is inexpensively and easily manufactured.

A further object of the invention is to provide an improved punch press controller which is compact and which can be easily incorporated into existing punch presses.

Still another object of the invention is to provide an improved punch press controller which immediately detects stoppage of a stock material, such as, a tape and has a sufficiently short response period to prevent damage to the press.

A still further object of the invention is to provide an improved automatic controller which can be easily modified to be used in either an operation where the stock material is cut or punched into separate pieces in the punch press, or in an operation where the integrity of the tape remains in tact after processing thereof in the press.

Other objects of the invention will become apparent to those skilled in the art upon studying this disclosure.

BRIEF DESCRIPTION OF THE DRAWINGS

FIG. 4 is a side elevational view, partially in cross section, of another embodiment of the punch press controller constructed in accordance with this invention including a schematic illustration of the electrical circuit.

FIG. 5 is a partial cross sectional view of the controller depicted in FIG. 4 taken along line 5—5 thereof.

FIG. 6 is a cross sectional view of the controller depicted in FIG. 4 taken along line 6—6 thereof.

FIG. 7 is partially schematical illustration of still another embodiment of the invention which includes a controller depicted in FIG. 2 or FIG. 4.

BRIEF DESCRIPTION OF THE INVENTION

Figure 1:
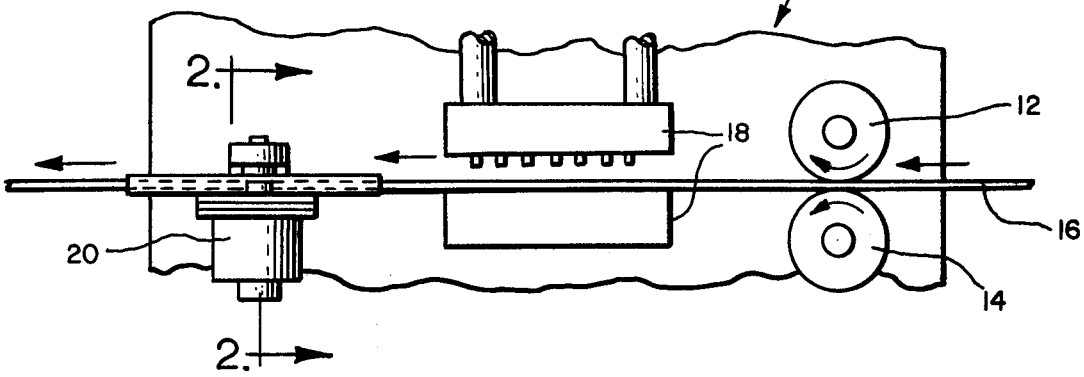
FIG. 1 is a partial side elevational view of a punch press which includes a controller constructed in accordance with this invention.

In accordance with one aspect of the invention, an automatic controller for stopping the punch press whenever the work piece becomes jammed or buckled, includes: translating means, rotating means and a movable element. The work piece exiting from the punch press causes rotation of the translating means which, in turn, imparts rotational motion to rotating means operatively associated with said translating means. The rotational motion produces centrifugal force that keeps the movable element in operating position. As the work piece buckles or becomes jammed in the punch press, the linear motion of the output end of the work piece ceases. As the result, the angular speed of the rotating means decreases and when the centrifugal force diminishes by a predetermined amount or is eliminated, the movable element moves to a position in which it actuates a switch that stops the operation of the punch press.

In accordance with another aspect of the invention, an automatic controller for stopping the punch press whenever the tape becomes jammed or buckled is composed of translating means, rotating means and a movable element. The separate items, or blanks, punched out by the press from a tape, fall onto and impart movement to translating means which translates the kinetic energy and the energy due to the weight of the blanks into rotational energy which, in turn, is transmitted to rotating means. The rotational motion of the rotating means creates centrifugal force which acts on a movable element to keep it in the position in which operation of the punch press is maintained. As soon as jamming or other malfunction takes place in the press, the continual emission of blanks from the punch press is interrupted, causing a slowdown and/or shortly thereafter a stoppage of the translating means. This action, in turn, causes a decrease in the rate and shortly thereafter stoppage of rotation of rotating means. As the centrifugal force decreases below a certain predetermined level or is entirely eliminated, the movable element actuates a switch which turns off the punch press.

DETAILED DESCRIPTION OF THE INVENTION

The punch press controller of the present invention automatically interrupts the operation of a punch press when a work piece passing through the punch press buckles or becomes jammed. As jamming or buckling of the work piece or stock material occurs in front or underneath the tool, the portion of the work piece which has moved past the tool stops and/or the emission of punched out items is interrupted. The controller of the present invention detects either the stoppage of the work piece, such as, a tape or the ceasing of production of punched-out items or blanks and responds to either or both of these conditions by actuating a switch to stop the operation of the punch press.

Jamming or buckling of the work piece, referred to in this specification, usually occurs between the feed mechanism and the tool of the press. Initial buckling or jamming is generally not dangerous; however, as the additional length of work piece is forwarded into the press, sufficient force is generated by the buckled work piece to seriously damage the punch press and possibly injure the operator. The controller of the present invention is designed to stop the press before damage to the press or the operator takes place.

The controller of the present invention includes a translating means for converting either the linear motion of the work piece, if it is in an integral form, or the kinetic and potential energy of punched out items to rotational motion of rotating means which is operatively associated with translating means. The rotational motion of the rotating means produces centrifugal force which keeps a movable element in operating position, i.e., in a position where it allows the continued operation of the press. As soon as the linear motion of the work piece or the emission of punched out items stops the centrifugal force decreases causing the movable element to move to a stopping position in which it actuates a switch turning off the punch press.

Throughout this disclosure, when reference is made to stopping of the press, it shall mean that the feed and tool mechanisms of the press are rendered inoperative. This is preferably accomplished by engaging a clutch to disconnect the mechanism driving the tool. Since the feed mechanism of the press is synchronized and interconnected with the tool, disconnecting of the mechanism driving the tool also renders the feed mechanism inoperative. Other methods of rendering the feed and tool mechanisms inoperative can also be employed. For example, if the feed mechanism and the tool are synchronized but not interconnected, both may need to be rendered inoperative. Although generally, the motor of the punch press is not turned off when the press is stopped, stopping of the press can also be accomplished by turning off the motor of the press.

The preferred embodiments of the invention will be described in detail in connection with the drawings. Referring now to FIG. 1 of the drawings, there is depicted a portion of a conventional punch press designated generally by a numeral 10. The punch press 10 includes a pair of feed rollers 12 and 14 for advancing the work piece, such as, a tape 16 toward a tool and die assembly 18 which is operated in a conventional manner. Rollers 12 and 14 are intended to illustrate any suitable feed mechanism. Generally, the feed mechanism feeds the tape in an intermittent manner and is interconnected and synchronized with a tool of the press so that each stroke of the tool advances the work piece into the press. The punch press controller of the present invention, designated by numeral 20, is located on the exit side of the tool and die assembly 18, i.e., on the side opposite from the side on which feeding rollers 12 and 14 are operating.

Figure 2:
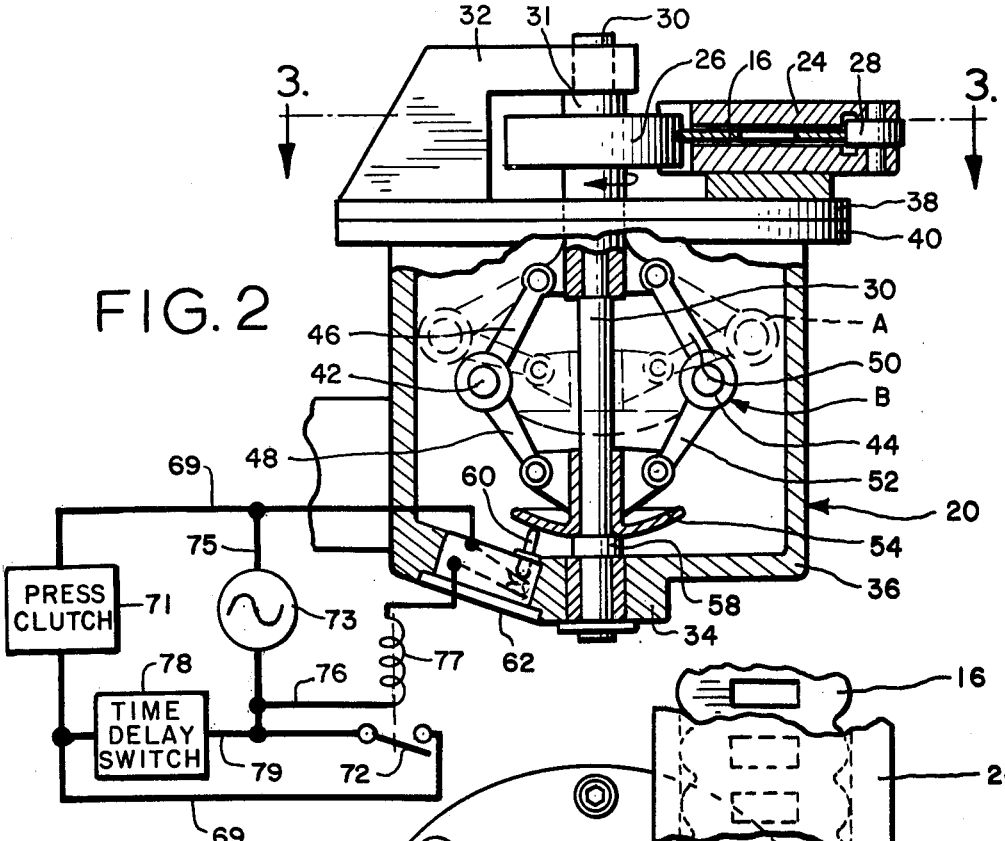
FIG. 2 is a cross sectional view of one embodiment of the punch press controller constructed in accordance with this invention, depicted in FIG. 1 and taken along line 2—2 thereof also including a schematic illustration of the electrical circuit.
Figure 3:
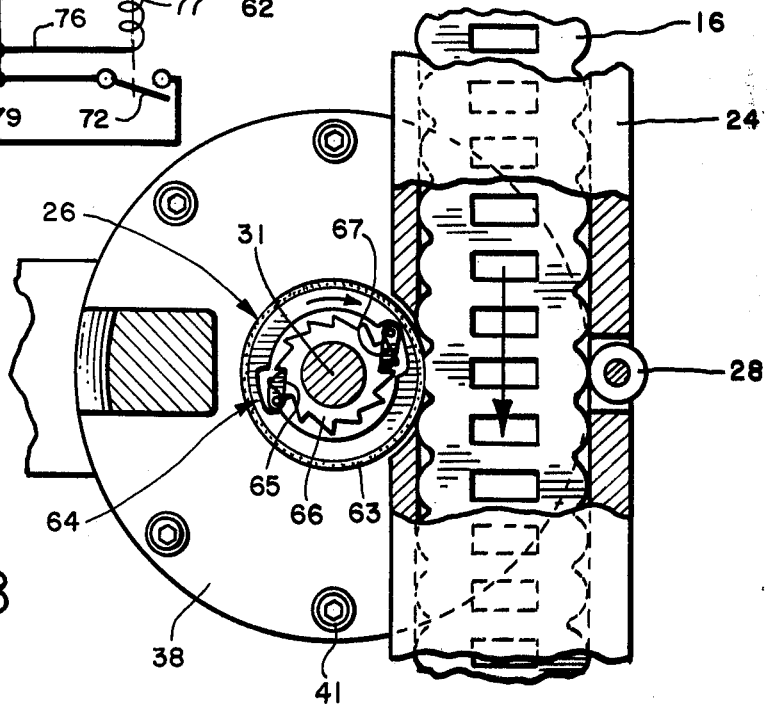
FIG. 3 is a partially cross sectional view of the controller depicted in FIG. 2 and taken along line 3—3 thereof.

FIGS. 2 and 3 show the details of one embodiment of the punch press controller 20 constructed in accordance with this invention. Referring now to FIG. 2, the controller 20 includes a guiding enclosure 24 for keeping the tape 16 wedged against a roller 26. In FIGS. 2 and 3, the enclosure 24 is shaped to accommodate and guide tape 16; however, it should be understood that the shape of the guiding enclosure depends and is determined by the shape of the work material that is being processed in the punch press. To decrease friction associated with keeping the tape 16 wedged against the roller 26, a roller 28 is rotatably mounted in the guiding enclosure 24 across the tape 16 from roller 26. The roller 26 is secured on a sleeve 31 which is rotatably mounted on a shaft 30. The shaft 30 is rigidly secured between a support arm 32 and a bottom portion 34 of the casing 36. The sleeve 31 passes through a support cover 38 and a casing cover 40, both of which are secured to the casing 36 by screws 41.

The controller 20 also includes fly weights 42 and 44. The fly weight 42 is pivotally connected to one end of arms 46 and 48. The other end of arm 46 is pivotally connected to the sleeve 31. The other end of arm 48 is pivotally connected to a sliding element 54. Similarly, arms 50 and 52 are pivotally connected to the fly weight 44 at one end and they are pivotally connected to the sleeve 31 and to the sliding element 54, respectively. The lower end of the sleeve can restrict the upward displacement of the sliding element 54. The position of the sliding element 54 in an upper position (i.e. operating position) is illustrated in FIG. 2 in phantom and designated by a letter A. An enlarged diameter section 58 of the shaft 30 restricts the downward displacement of the sliding element 54 along the shaft 30 to keep the fly weights 42 and 44 displaced away from the shaft 30. The position of the sliding element 54 against the enlarged diameter section 58 is illustrated in FIG. 2 and designated by a letter B. In the B position, the sliding element 54 pushes downward the actuating rod 60 of the switch 62 secured at the bottom of the casing 36, closing the contacts of said switch 62. The actuating rod 60 is normally maintained in an upward (open) position by any suitable means such as a spring. A branch 69 of the circuit connects one contact point of the switch 62 with a press clutch 71 and through circuit switch 72 to the electric current source 73. The current source 73 is connected with branch 69 via 75. The coil circuit includes a portion of branch 69, branch 75, current source 73, branch 76, coil 77 and switch 62. The coil circuit, when closed, causes the coil 77 to open the circuit switch 72. Time delay switch 78 provides a by-pass of the switch 72 via branch 79.

FIG. 3 shows the details of the portion of the controller 20 for translating linear motion of the tape 16 into rotational motion, designed to maintain the angular motion of the sleeve 31 at a uniform rate even when the tape 16 is fed to the press intermittently. The roller 26 includes an outside layer 63 preferrably made of a resilient material, such as, rubber and a ratchet 64 having two pawls 65 held against the ratchet wheel 66 by biasing springs 67. The ratchet wheel 66 is rigidly mounted to the sleeve 31.

In operation, the tape 16 is advanced by rollers 12 and 14, or another suitable mechanism, in intermittent manner. The tool and die assembly 18 operates in a conventional manner to process the tape 16 as desired. The tape 16 exiting from the tool and die assembly 18 enters the enclosure 24 which maintains the tape 16 passing therethrough tightly against the layer 63. The rotation of the sleeve 31 generates centrifugal force which maintains the arm assemblies 42 and 44 in position designated in FIG. 2 by letter A. The ratchet 64 assures a uniform angular motion of the sleeve 31, despite intermittent feed of the tape 16. The switch 62 remains in a position which permits the normal operation of the punch press 10.

When the tape 16 becomes jammed or buckles, the advancing tape 16 usually accumulates in the space between the tool and die assembly 18 and the feed mechanism represented in FIG. 1 by rollers 12 and 14. As the tape 16 accumulates in that space (or between the die and the tool), the motion of the tape through the enclosure 24 ceases; consequently, the sleeve 31 is not driven at the angular velocity necessary for generating sufficiently large centrifugal force to maintain the sliding element 54 in position A. As the inertia further slows down the rotation of the sleeve 31, the sliding element 54 descends due to force of gravity into position B, onto the rod 60 of the switch 62 actuating said switch 62 to engage the clutch 71 and stop the motion of the tool and feed mechanism.

The electrical circuit 69 includes a conventional time delay switch 78 which is designed to permit starting or restarting of the press 10 despite the switch 62 being in an off position. When the press 10 is stopped, the switch 62 is maintained in a closed position by the sliding element 54 so that coil 77 holds the circuit switch 72 in an open position. To start or restart the press 10, the time delay switch 78 is closed thereby providing a by-pass of the open circuit switch 72 and placing the press clutch 71 in an operating position. As the press 10 begins to operate, the sliding element 54 moves upward. The switch 62 opens up, causing the circuit switch 72 to close. The time delay switch 78 is then opened either automatically (as by use of a timer) or by the action of the operator.

Second Embodiment

The second embodiment of the controller 20', which in operation, is located in the location shown in FIG. 1, is depicted in FIGS. 4 through 6. Referring now to FIG. 4, the controller is designated generally by a numeral 20'. It includes an enclosure 80 for guiding the tape 16 passing therethrough. The tape 16 is always kept pushing against the roller 82 the outside layer 83 of which is preferably made out of resilient material, such as, rubber. Across the tape 16, on the opposite side from the roller 82, there is a roller 84 preferably made of a rigid material to minimize the friction generated by the passing of the tape 16. The roller 82 is rotatably mounted in the enclosure 80. The roller 82 is rigidly secured to and coaxial with shaft 86, which is rotatably mounted in a casing cover 88. As shown in FIG. 4, the cover 88 is composed of two sections which are bolted to the casing 90 by suitable securing means, such as, bolts 92. The enclosure 80 is supported by a block 94 secured to the casing cover 88. A hollow bulb 91 is rigidly secured to the lower end of the shaft 86. The bulb 91 is made of an electrically nonconducting material, such as, glass or plastic. The solid cylindrical portion 92 of the bulb 91 has a bore therethrough. A pin 94 fits tightly against the sides of the bore. The pin head 96 extends into the hollow 98 of the bulb 91. The opposite end of the pin 94 has a lower end 99 extending from the cylindrical portion 92 and fitting tightly against it. The pin 94 is made of an electrically conductive material, such as copper or other metals.

The cylindrical portion 92 is partially enclosed by a tube 101 made of an electrically conductive material, such as brass, and having four prongs 102 which extend through the walls of the bulb 91 into the hollow 98. As shown in FIG. 6, the tube 101 is coaxial with respect to the center of the bulb 91 and the prongs 102 are spaced uniformly around the pin head 96.

The bulb 91 fits inside a space 103 which is defined by the casing 90 and the casing cover 88. The casing 90 has a bore therethrough lined with an outside tubular liner 104 made of electrically nonconducting material and an inside liner 106 made of electrically conducting material. The lower portion of the inside tubular liner 106 includes a threaded section. The inside tubular liner 106 is connected to one lead 107 of a coil circuit. The other lead 108 of the coil circuit is connected to a member 112 of a plug 114 which is threated into the inside tubular liner 106. The plug 114 includes a hollow cylindrical member 116 which is electrically nonconductive and a cap 120 made of electrically conductive material, such as, copper or other metals. The cap 120 has a lip 121 on its lower edge to assure that it is retained in the plug 114 when the plug 114 is removed. The lip 121 engages the lip 122 of the plug 114 when the plug 114 is removed. A helical spring 123 maintains the cap 120 positioned securely against the lower end 99 of the pin 94.

The coil circuit also includes a branch 140, a current source 141, branch 142 and coil 143. The coil 143 opens up a normally closed circuit switch 144 of the press clutch circuit when the coil circuit is closed. The press clutch circuit also includes branch 145, a press clutch 146 and a by-pass branch 147 which includes a time delay switch 148.

Inside the hollow 98 there is liquid, such as mercury (Hg), which can conduct electric current. The amount of mercury should be sufficiently large to provide connection between prongs 102 and the pin head 96 when the mercury is on the bottom of the hollow 98, but sufficiently small to completely disrupt the connection between prongs 102 and pin head 96 when the desired angular velocity of the bulb 91 is achieved. It should be noted that the rotation of the shaft 86 causes rotation of the bulb 91 including rotation of the cylindrical portion 92, enclosed by the tube 101, inside the inside tubular liner 106.

As shown in FIG. 5, the roller 82 does not include a mechanism designed to maintain the angular motion of the shaft 86 at a uniform rate even if the tape 16 is fed intermittently. It should be pointed out, however, that mechanism of the embodiment depicted in FIG. 2 and FIG. 3 can, if needed, be employed in connection with the embodiment depicted in FIGS. 4–6 and vice versa.

In operation, the tape 16 is advanced into the press 10 by a feed mechanism, such as, rollers 12 and 14. Generally the feed mechanism advances the tape 16 intermittently after each stroke of the tool. Usually the feed mechanism is connected to the tool driving mechanism so that the feed of the tape 16 and the operation of the tool are synchronized. The tape 16 is processed in the tool and die assembly 18 and is advanced into the enclosure 80 which can be of configuration which permits keeping the tape 16 tightly against the resilient outer layer 83 of roller 82. The motion of the tape 16 imparts rotational motion to the roller 82 and the shaft 86. The shaft 86, in turn, rotates the bulb 91. An appropriate lubricant, such as graphite, or a bearing can be provided to decrease the friction between the tube 101 and the outside liner 106. The rotation of the bulb 91 generates a centrifugal force which displaces and maintains a liquid conductor, such as, mercury (Hg) in position designated in FIG. 4 by a letter A.

As jamming or buckling occurs, as described in connection with the first embodiment, the tape 16 in the enclosure 80 stops which causes corresponding slow down and stoppage of the bulb 91. As the bulb 91 stops, the centrifugal force acting on mercury (Hg) ceases entirely and the mercury (Hg) flows due to the force of gravity to position designated on FIG. 4 by letter B. In B position the mercury (Hg) closes the contact between the pin head 96 and prongs 102 which causes closing of the contact between the two leads of the circuit.

Closing of the coil circuit activates the coil 143 which acts to open the normally closed circuit switch 144. Closing of the switch 144 engages the clutch 146 which disengages the punch press 10 from the driving mechanism (not shown). To start or restart the press 10, the time delay switch 148 is closed thereby completing the press clutch circuit and disengaging the clutch 146 to begin the press clutch operation of the mechanism (not shown) driving the tool. After the mercury rises to the A position, the coil circuit opens and the switch 144 returns to its normally closed position. FIG. 4 illustrates the system a moment before switch 144 moves to the closed position. After switch 144 closes, the time delay switch 148 is opened either automatically or by the action of an operator.

It should be clear from the description and FIGS. 2–5 that the roller frictionally engages the work piece.

The Third and Fourth Embodiments

In a situation where the punch press produced (punches out) individual items, these items can be utilized to power a paddle wheel which, in turn, can provide necessary rotation to operate the device constructed in accordance with either the modified first or modified second embodiment of the invention. The third and fourth embodiments are particularly useful in a situation where punching out of the items or blanks destroys the integrity of the work piece, such as, tape so that embodiments depicted in FIGS. 1–6 cannot be operated as heretofore described.

Referring now to FIG. 7, there are depicted the third and the fourth embodiment of the present invention. The third embodiment includes a modified controller of the first embodiment of the present invention and the fourth embodiment includes a modified controller of the second embodiment of the present invention. The device depicted in FIG. 7 includes a hopper 150 and a paddle wheel 152 rotatably mounted inside the hopper 150. The wheel 152 is mounted in such a location and the hopper is shaped in such a manner as to allow the items or blanks 156 punched out from the tape 16 to turn the paddle wheel 152 only in one direction. To this objective, the hopper has one of its walls slanting downward so that the items 156 can fall only on one side of the paddle wheel 152. The wheel 152 includes a plurality of paddles 158 in the form of rectangular sheets and a central shaft 160. The paddles 158 are rigidly connected to the wheel 152 along one of their edges. The paddle wheel 152 is operatively associated, such as, through shafts 161 and 162 having beveled gears 163 and 164, respectively, with the sleeve 31 of the first embodiment or the shaft 86 of the second embodiment (not shown). Of course, the mechanisms of the first and second embodiment need not include the enclosure for guiding tapes and the rollers for translating the linear motion of the tape into the angular motion.

In operation, the items 156, punched out by the tool of the press, fall into the hopper 150 and descend toward the paddles 158. As an item 156 comes in contact with one of the paddles 158, it causes rotation of the paddle wheel 152 (in a counter-clockwise direction in the system depicted in FIG. 7) because of the kinetic energy and the weight of the pieces. The rotation of the paddle wheel 152 is transmitted to a mechanism of the first or second embodiment via shaft 161 having the beveled gear 163 meshing with beveled gear 164 and via shaft 162. If buckling or jamming occurs in the press, the tape 16 is not advanced through the tool, consequently, items 156 are no longer dropped into the hopper 150. Without the energy provided by the falling items 156, the paddle wheel 152 slows down and soon thereafter comes to a stop. Slowing down and stopping of the paddle wheel 152 is transmitted to the sleeve 31 or shaft 86 depending on which controller is used. As the sleeve 31, the shaft 86 slows down and comes to a halt, the sliding element 54 of the first embodiment or the mercury in the second embodiment (depending on which embodiment is used) actuate the switch as described in connection with the discussion of the first and second embodiment to turn off the press.

Many changes and modifications will occur to those skilled in the art upon studying this disclosure. All such changes and modifications, which fall within the spirit of this invention, are intended to be included within its scope.

I claim:

1. A punch press controller for stopping a punch press when buckling or jamming of the work piece takes place in the punch press, said controller comprising:

rotating means;

a roller rigidly connected to said rotating means and frictionally engaging said work piece;

means for maintaining the work piece exiting from the punch press against said roller;

a movable element operatively associated with said rotating means; and a switch actuated by said movable element, said roller converting the linear motion of the work piece exiting from the punch press into rotational motion of said rotating means, the rotational motion of said rotating means generating centrifugal force of a sufficient magnitude to maintain the movable element in an operating position only as long as the work piece is exiting from the press, said movable element moving to actuate said switch turning off the press as soon as the work piece stops exiting from the press, so that the controller is powered solely by the motion of said work piece.

2. A punch press controller as claimed in claim 1 wherein:

a. said means for maintaining the work piece against the roller comprises
an enclosure;

b. said rotating means comprises:
a shaft, a sleeve rotatably mounted on said shaft and rigidly connected to said roller; and, c. said movable element comprises a sliding element slidingly mounted on said shaft and at least one fly weight, each fly weight having a first arm pivotally connected to the fly weight and to said sleeve, and a second arm pivotally connected to the fly weight and to the sliding member.

3. A punch press controller as claimed in claim 1 wherein:

a. said means for maintaining the work piece against the roller comprises
an enclosure;

b. said rotating means comprises:
a shaft, a sleeve rotatably mounted on said shaft, a ratchet rigidly connected to said sleeve and driven by said rollers; and c. said movable element comprises a sliding element mounted on said shaft and a plurality of fly weights, each fly weight having a first arm pivotally connected to said fly weight and to said sleeve and a second arm pivotally connected to the fly weight and to the sliding member, said ratchet providing for a uniform rotation of said sleeve even if the work piece is fed in an intermittent manner.

4. A punch press as claimed in claim 1 wherein:

a. said means for maintaining the work piece against the roller comprises
an enclosure;

b. said rotating means comprises:
a rotatably mounted shaft, a bulb rigidly connected to said shaft, said bulb having a hollow therein, electrical contacts within said hollow;

c. said movable element comprises a liquid conductor partially filling said hollow;

d. a ratchet operatively connected to said shaft, said ratchet providing for a substantially uniform rotation of said shaft even if the work piece is fed into the punch press in an intermittent fashion.

5. A punch press controller as claimed in claim 1 wherein:

a. said means for maintaining the work piece against the roller comprises
an enclosure;

b. said rotating means comprises:
a rotatably mounted shaft, a bulb rigidly mounted thereto having a hollow therein, and electrical terminals within said hollow;

c. said movable element comprises a liquid conductor.

6. A punch press as claimed in claim 5 wherein said liquid conductor is mercury.

7. In a punch press of the type having a tool for processing a work piece, a feeding mechanism in front of said tool for feeding the work piece to the tool and a controller behind the tool for detecting stoppage of the work piece due to buckling or jamming of the work piece between the tool and the feeding mechanism, the improvement comprising said controller including:

translating means;

rotating means operatively associated with said translating means;

a movable element operatively associated with said rotating means; and, switching means actuated by said movable element, said translating means converting the linear motion of the work piece exiting from the punch press into rotational motion of said rotating means, the rotational motion of said rotating means generating centrifugal force or a sufficient magnitude to maintain the movable element in an operating position only as long as the work piece is exiting from the press, said movable element moving to actuate said switching means turning off the press as soon as the work piece stops exiting from the press, said controller being powered solely by the exiting work piece.

8. A punch press as claimed in claim 7 wherein:

a. said translating means comprises:
a roller and an enclosure for maintaining said work piece against the roller;

b. said rotating means comprises:
a shaft, a sleeve rotatably mounted on said shaft and rigidly connected to said roller; and, c. said movable element comprises a sliding element slidingly mounted on said shaft and at least one fly weight, each fly weight having a first arm pivotally connected to the fly weight and to said sleeve, and a second arm pivotally connected to the fly weight and to the sliding member.

9. A punch press as claimed in claim 7 wherein:

a. said translating means comprises:
a roller and an enclosure for maintaining said work piece against the roller;

b. said rotating means comprises:
a rotatably mounted shaft, a bulb rigidly mounted thereto having a hollow therein, and electrical terminals within said hollow;

c. said movable element comprises a liquid conductor.

10. A punch press as claimed in claim 7 wherein:

said translating means comprises a paddle wheel driven by the work pieces cut out by the press.

11. A punch press controller for stopping a punch press when buckling or jamming of the work piece takes place in the punch press, said controller comprising:

a shaft;

a sleeve rotatably mounted on said shaft;

a roller rigidly connected to said sleeve;

a sliding element slidingly mounted on said shaft;

at least one fly weight, each fly weight having first and second arm, the first arm being pivotally connected to said fly weight and to said sleeve, the second arm being pivotally connected to said fly weight and to said sliding member;

a paddle wheel operatively connected to said sleeve, said paddle wheel being driven by work pieces punched out by the punch press; and, a switch activated by said sliding element said paddle wheel converting linear motion of the punched out work pieces into rotational motion of said sleeve, the rotational motion of said sleeve generating a centrifugal force of a sufficient magnitude to maintain the fly weight displaced from the shaft and the sliding element in an operating position, the stoppage of punched out work pieces causing the sliding element to be displaced along the shaft to turn off the punch press.

12. A punch press as claimed in claim 11 further comprising a ratchet operatively associated with said sleeve, said ratchet providing for a substantially uniform rotation of said shaft even if the work piece is fed into the punch press in an intermittent fashion.

13. A punch press controller for stopping a punch press when buckling or jamming of the work piece takes place in the punch press, said controller comprising:

a rotatably mounted shaft;

a bulb rigidly mounted thereto having a hollow therein, and electrical terminals within said hollow;

a liquid capable of conducting electricity partially filling said hollow;

a paddle wheel operatively connected to said shaft, said paddle wheel being driven by work pieces punched out by the punch press; and switching means actuated by said liquid, said paddle wheel converting the linear motion of said punched out work pieces into rotational motion of said shaft and the bulb, said rotational motion generating centrifugal force of a sufficient magnitude to maintain the liquid in an operating position, the liquid flowing to actuate switching means and stopping the punch press as soon as the punched out work pieces cease exiting from the punch press.

14. A punch press as claimed in claim 13 further comprising a ratchet operatively associated with said shaft, said ratchet providing for a substantially uniform rotation of said shaft even when the work piece is fed into the punch press in an intermittent manner.

15. A punch press as claimed in claim 13 wherein said liquid is mercury.

* * * * *